US008800511B2

(12) United States Patent
Weber

(10) Patent No.: US 8,800,511 B2
(45) Date of Patent: Aug. 12, 2014

(54) CAMSHAFT ADJUSTER

(75) Inventor: Jürgen Weber, Erlangen (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 66 days.

(21) Appl. No.: 13/548,602

(22) Filed: Jul. 13, 2012

(65) Prior Publication Data

US 2013/0019829 A1 Jan. 24, 2013

(30) Foreign Application Priority Data

Jul. 22, 2011 (DE) ..... 10 2011 079 609

(51) Int. Cl.
*F01L 1/34* (2006.01)
*F02B 77/04* (2006.01)

(52) U.S. Cl.
USPC ..... 123/90.15; 123/198 E

(58) Field of Classification Search
USPC ..... 123/90.15, 90.17; 464/173, 175
See application file for complete search history.

(56) References Cited

U.S. PATENT DOCUMENTS

| | | | | |
|---|---|---|---|---|
| 7,475,660 | B2 * | 1/2009 | Lichtenwald et al. | 123/90.17 |
| 7,587,227 | B2 * | 9/2009 | Cheung et al. | 455/575.6 |
| 2011/0120399 | A1 * | 5/2011 | Weber | 123/90.15 |

FOREIGN PATENT DOCUMENTS

DE 102007039282 2/2009

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A camshaft adjuster (1) having a drive element (2), an output element (3), and a cover element (4), the cover element (4) being joined to the drive element (2) or to the output element (3) and having defined, deformable zones (5) that deform under the action of a force F, resulting in a deformation of the cover element (4), whereby the cover element (4) can be disassembled from or assembled to the drive element (2) or the output element (3).

9 Claims, 6 Drawing Sheets

CAMSHAFT ADJUSTER

CROSS-REFERENCE TO RELATED APPLCIATIONS

This application claims the benefit of German Patent Application No. 102011079609.6, filed Jul. 22, 2011, which is incorporated herein by reference as if fully set forth.

FIELD OF THE INVENTION

The present invention relates to a camshaft adjuster.

BACKGROUND

Camshaft adjusters are used in internal combustion engines to vary the control times of the combustion chamber valves, in order to make it possible to variably configure the phase relation between the crankshaft and the camshaft in a defined angular range, between a maximum early position and a maximum late position. The matching of the control times to the current load reduces consumption and reduces emissions. For this purpose, camshaft adjusters are integrated into a drivetrain via which a torque is transmitted from the crankshaft to the camshaft. This drivetrain can for example be realized as a belt drive, a chain drive, or a gear drive.

In a hydraulic camshaft adjuster, the output element and the drive element form one or more pairs of pressure chambers that act opposite to one another, and to which oil pressure can be applied. The drive element and the output element are configured coaxially. Through the filling and emptying of individual pressure chambers, a relative movement is produced between the drive element and the output element. The spring, acting rotationally between the drive element and the output element, impels the drive element in an advantageous direction relative to the output element. This advantageous direction may be in the same sense as, or in the opposite sense to, the direction of rotation.

A commonly used design of hydraulic camshaft adjuster is the vane-cell adjuster. Vane-cell adjusters have a stator, a rotor, and a drive element. The rotor is usually connected in rotationally fixed fashion to the camshaft, and forms the output element. The stator and the drive element are also connected in rotationally fixed fashion to one another, and are also fashioned in one piece if warranted. Here, the rotor is configured coaxially to the stator and inside the stator. With their radially extending vanes, the rotor and stator define oil chambers (vane cells) that act opposite one another and on which oil pressure can act, and which enable a relative movement between the stator and the rotor. In addition, the vane-cell adjusters have various sealing covers. The stator, the drive element, and the sealing cover are secured by a plurality of screwed connections.

Another known type of hydraulic camshaft adjuster is the axial piston adjuster. Here, oil pressure axially displaces a displacement element that, via helical gearings, produces a relative rotation between a drive element and an output element.

A further design of a camshaft adjuster is the electromechanical camshaft adjuster, which has a three-shaft transmission (for example a planetary transmission). Here, one of the shafts forms the drive element and a second shaft forms the output element. Via the third shaft, rotational energy can be supplied to the system or carried away from the system by an actuating device such as an electric motor or a brake. Here, a spring can likewise be situated in such a way that the drive element and the output element support one another or guide one another back during their relative rotation.

DE 10 2007 039 282 A1 provides a camshaft adjuster having a cover hood that is fixedly connected to the belt pulley by snap hooks integrally formed on the cover hood. For this purpose, the belt pulley has a plurality of openings through which the snap hooks are inserted and lock. Through the use of insert elements, the snap connection is secured against later accidental detachment of the connection.

SUMMARY

The object of the present invention is to provide a camshaft adjuster that has simple assembly and disassembly of a cover element.

This object is achieved by one or more features of the present invention.

In this way, it is achieved that when a force acts on a defined, deformable zone of the one component, in particular the cover element, which is connected to another component, in particular the drive element or the output element, the radial distance from the contact surface of the component to its mid-axis is enlarged, so that the component connection is released, and sufficient access is present between the two components for assembly/disassembly. Advantageously, the impression of the force is possible without the use of additional mechanical means (tools). The assembly/disassembly can take place quickly and easily by hand, by exerting pressure on the defined zones. The defined zones are preferably identified to the person performing the assembly, i.e. they stand out optically and/or topographically from the rest of the component surface. Such a joined connection is characterized by contact surfaces that are fashioned in one piece with the components that are to be connected, with the contact surfaces preferably being in immediate contact with one another. A joined connection as such is preferably present in the form of a positive and/or non-positive connection.

A cover element of a camshaft adjuster is to be understood as a cover hood or spring cover or the like. Cover elements or hoods seal or cover peripheral components against the surrounding environment. A spring cover limits a spring chamber in which a spring, e.g. a return spring, may be situated. Cover elements can be situated on the side of the camshaft adjuster facing the camshaft or on the side facing away from the camshaft.

Advantageously, the cover element has a plurality of defined deformable zones, which, through the application of pressure or force thereon, preferably elastically deform a cover element in such a way that the joined connection is released. The elastic deformation of the defined zones acts on almost the entire component, which is itself elastically deformed. This overall deformation culminates in a dismantling of the joined connection. An elastic deformation is, as far as possible, such that the dimensions of the component before and after assembly/disassembly remain almost unmodified. A plastic deformation in extremely small portions should not hinder reuse of the component for a new assembly/disassembly.

The joined connection is fashioned either as a positive connection or as a non-positive connection and is made so that it can be released without damaging the component. Preferably, a positive connection is provided in which surfaces, in particular contact surfaces, stand opposite one another as orthogonally as possible to the join direction, in such a way that at least a direction at one side is blocked. This joined connection is advantageously very resistant to the action of external forces such as vibrations resulting from the operation of the internal combustion engine. A combination of an interference fit assembly and a positive connection increases the reliability of the joined connection, and is therefore preferably to be used.

A joined connection as a non-positive connection, in contrast to the joined connection as a positive connection, is characterized in that the surfaces, in particular the contact surfaces, extend parallel to the join direction as much as possible.

The radial increasing of the distance of the one contact surface of the cover element, or output element or drive element, from its mid-axis is indispensable for the releasing of the joined connection, so that free access, necessary for assembly/disassembly, results to the complementary contact surface of the other component. Because the cover elements, output elements, and drive elements used for a camshaft adjuster are rotationally symmetrical in construction, a plurality of joined connections are advantageously distributed about their circumference, so that when a force is applied an imaginary envelope, including the joined connections, becomes larger in its radius, so that the joined connection supplies the desired degree of freedom for disassembly/assembly.

In order to enable the joined connection to be released, a lever arm is required from the defined zone to the contact surface. The lever arm is oriented in the circumferential direction, i.e. the secant direction, or in the axial direction.

In an embodiment of the present invention, the force vector that is to be introduced for assembly/disassembly, or the elastic deformation required for the assembly/disassembly, is oriented in the axial, radial, or circumferential direction.

Advantageously, a radial direction is preferably to be applied, because in this way the defined, deformable zones can be pressed in the radial direction (towards the mid-axis) easily and ergonomically by hand, without using additional mechanical means, and the lever arm applies the force over or under the joined connection, supplying the degree of freedom for the assembly/disassembly.

Alternatively, mechanical means such as tools may be used for the assembly/disassembly.

In a preferred embodiment of the present invention, the defined deformable zone is fashioned as a bulge. The bulges have, to the greatest possible extent, the same wall thicknesses as the overall component (cover element, output element, or drive element), which advantageously has a cup-shaped design. The cup shape or circular shape is distinguished by a floor that extends in the radial direction, having an edge that is formed in the axial direction and that stands out from the floor. The bulge for the introduction of the deformation of the component when force is correspondingly applied is advantageously fashioned in one piece with the component. Such a bulge makes the region that is to be acted on optically and/or topologically recognizable to the person performing the assembly.

In a particularly preferred embodiment, at least one of the components is made of sheet metal; advantageously this is the component that is to be elastically deformed. Embodiments having a cup shape/circular shape are advantageous in production, in the functioning of the controlled elastic deformation. Alternatively, the component can have materials of plastic or a similar material having a corresponding modulus of elasticity. The use of a suitable material for the elastic deformation advantageously has resilient properties.

In one embodiment of the present invention, the defined deformable zone is provided as a bulge, and at the same time as an angular positioning between the cover element and the drive element or output element. The optical and/or topological identification of the defined, deformable zone as a bulge creates an aid to orientation for the two components that are to be connected. The cover element can have an irregularity having a non-repeating shape, e.g. the situation of a locking slotted piece in which a locking projection can engage. In this way, this locking slotted piece, preferably situated on the inner side of the cover element, can be placed in alignment with the locking projection, which is preferably situated on the output element.

In an alternative embodiment of the present invention, the defined, deformable zone is not fashioned as a bulge, but rather is a region identified with symbols on the standard wall of the cover element. The force for the introduction of the elastic deformation is applied within this identified region. The force vector can be oriented radially, axially, or in the circumferential direction.

On the opposite side of the wall and of the identified region, a recess is provided on the complementary component, which has counter-supports on its edge parts for supporting the applied force. These counter-supports are fashioned on the cover element or on the complementary component, and on the one hand are used to provide a radial or axial distance between the two components so that the identified region can be deformed under the action of a radial force in the direction of the mid-axis. On the other hand, the counter-support forms a lever arm to the introduced force, so that this elastic deformation can take place. The joined connection is situated outside the identified region, and is to the greatest possible extent elastically deformed in a manner directed opposite to the elastic deformation of the identified region.

In an advantageous embodiment, one of the joined components has a groove as a component of the joined connection. This groove is suitable for creating a positive connection, but can additionally be used to secure the interference fit assembly in the case of a combination of a positive connection and a non-positive connection.

In a particularly preferred embodiment, the groove is made completely circumferential or partially circumferential. A completely circumferential groove is advantageous for a rotationally symmetrical processing, which is simple and more economical. A partially circumferential groove has the advantage that it is fashioned specifically at the regions provided for the joined connection.

In a particularly preferred embodiment of the present invention, the cover element sheathes the drive element or output element. Through such a sheath, in the extreme case the drive element or output element is advantageously tightly encapsulated to the greatest possible extent, and is protected from foreign materials and external influences. A further embodiment of this sheath is made so as to provide permeability of the hydraulic medium to the surrounding environment.

The system according to the present invention achieves a simple assembly/disassembly of a cover element. The embodiment according to the present invention of the zones fashioned specifically for the introduction of force can be situated on the cover element, on the drive element, or on the output element. In addition, the integrative embodiment according to the present invention on a component fashioned as a shaped part as named above reduces costs in mass production

BRIEF DESCRIPTION OF THE DRAWINGS

Exemplary embodiments of the present invention are shown in the Figures.

DETAILED DESCRIPTION OF THE PREFERRED EMBODIMENTS

Figure 11:
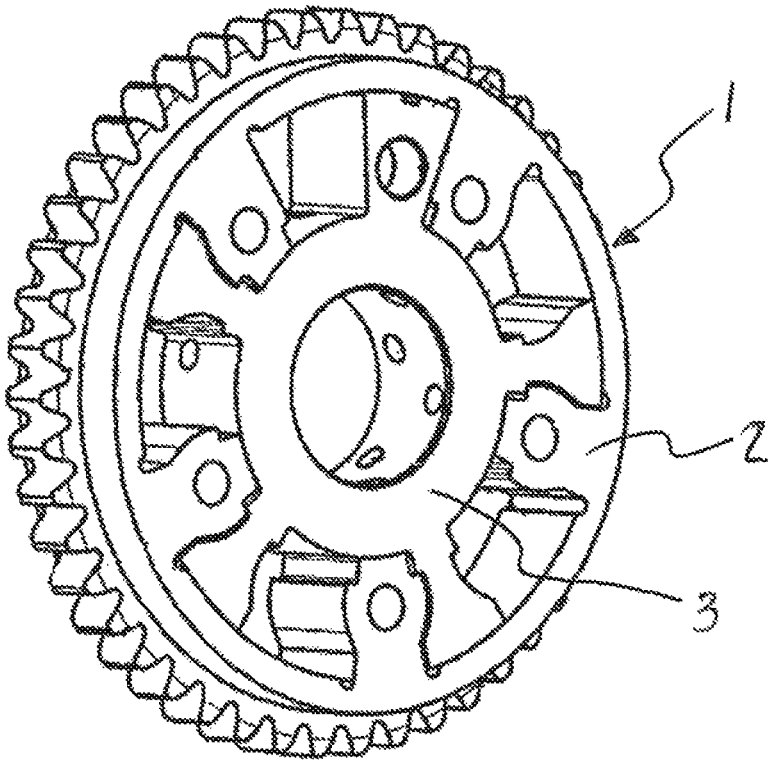
FIG. 11 (Prior Art)
FIG. 11 shows a camshaft adjuster including a drive element and output element according to the prior art.

FIG. 11 shows a camshaft adjuster 1 including a drive element 2 and output element 3 according to the prior art.

Figure 1:
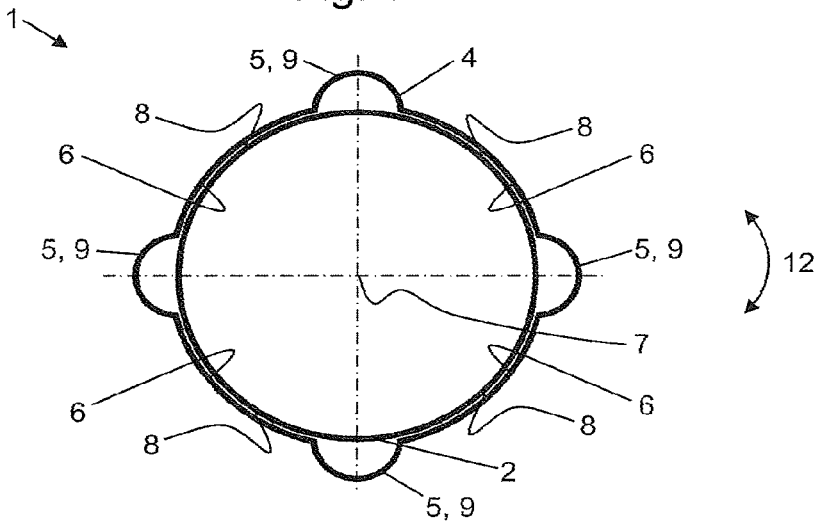
FIG. 1 shows a schematic representation of components connected to one another with a non-positive connection, viewed toward the end face of the camshaft adjuster.

FIG. 1 shows a schematic representation of components 4 and 2 or 3, non-positively connected to one another, viewed toward the end face of camshaft adjuster 1. In FIG. 1, the camshaft adjuster 1 has a cover element 4 and a drive element 2. The drive element 2 and the cover element 4 have a mid-axis 7 about which both components, or the camshaft adjuster 1, rotate in a circumferential direction 12 during operation. The drive element 2 has the formation of the vanes and hydraulic medium channels known from the prior art, necessary for the operation of a hydraulic vane-cell adjuster. The cover element 4 has a plurality of defined deformable zones 5 distributed in the circumferential direction 12. These defined deformable zones 5 are fashioned as bulges 9 of the cover element 4. The cover element 4 has a thin-walled circular or cup shape. Between defined the deformable zones 5 in the circumferential direction 12, there are situated contact surface 6 of the cover element 4 and complementary contact surface 11 of the drive element 2, these contact surfaces being provided for joined connection 8. The cover element 4 sheathes the circumference of the drive element 2. The contact surfaces 6 and 11 create a frictional, rotationally and axially fixed connection of the two components. The contact force in the region of the contact surfaces is accordingly sufficient for a reliable frictional joined connection 8.

Figure 2:
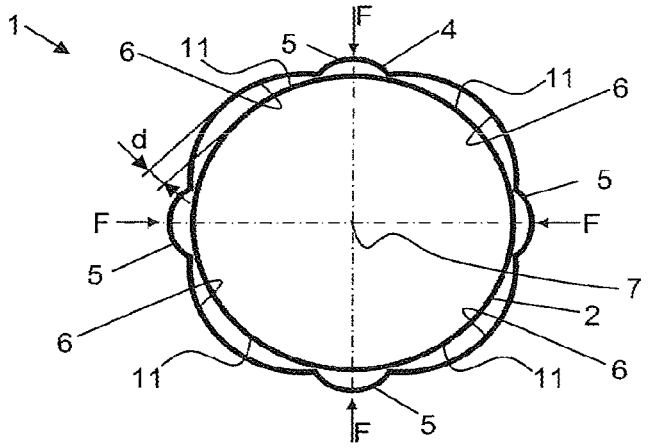
FIG. 2 shows a schematic representation according to FIG. 1, with the resulting deformation for disassembly.

FIG. 2 shows a schematic representation according to FIG. 1, with the resulting deformation for disassembly. Through the action of a force F in the direction of the mid-axis 7 on the defined deformable zones 5, the zones are elastically deformed as far as possible, so that the frictional connection between the contact surfaces 6, 11 is dismantled. The dismantling of the frictional connection results from the removal of the contact surface 6 from the complementary contact surface 11, predominantly in the radial direction. Through the convex curvature of the contact surface 6 and 11, due to the formation of the cover element 4 and of the drive element 2 as a rotational component, the curved contact surface 6 is also deformed as an effect of the cause of the deformation of the zones 5. The radial distance of the contact surface 6 increases, releases the frictional connection, and creates sufficient distance d, thus creating free access for a disassembly of the cover element 4 from the drive element 2.

Figure 3:
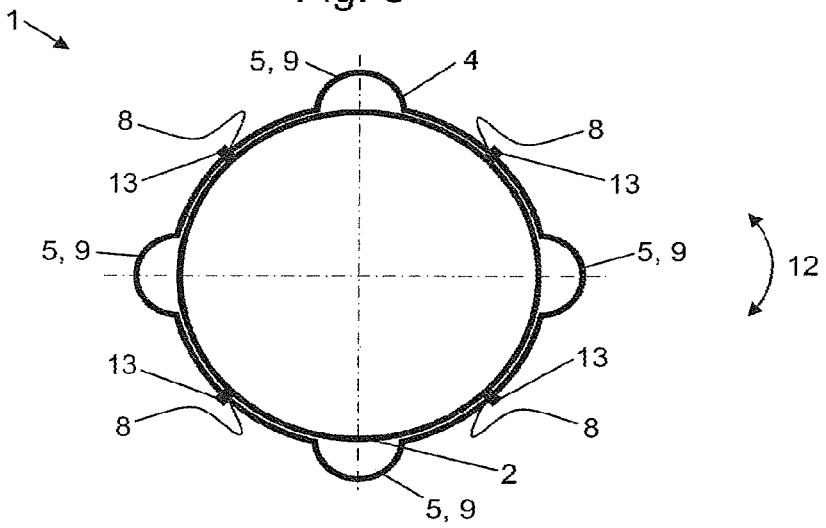
FIG. 3 shows a schematic representation of components connected to one another with a positive connection, viewed toward the end face of the camshaft adjuster.

FIG. 3 shows a schematic representation of components 4 and 2 or 3, connected positively to one another, viewed toward the end face of the camshaft adjuster 1. In FIG. 3, the camshaft adjuster 1 has a cover element 4 and a drive element 2. The construction is similar to that shown in FIG. 1, but with the difference that instead of a non-positive joined connection, a positive joined connection is formed between the cover element 4 and the drive element 2. The drive element 2 has a plurality of positive connecting elements 13 provided in the joined connection. The positive connecting elements 13 are advantageously fashioned in one piece with the drive element 2. Optionally, the positive connecting elements 13 can be fashioned separately from the drive element 2 and can be connected fixedly to one another, directly or intermediately. The positive connecting elements 13 extend predominantly in the radial direction. As in FIG. 1, the positively connected joined connections 8 are situated between the defined deformable zones 5.

Figure 4:
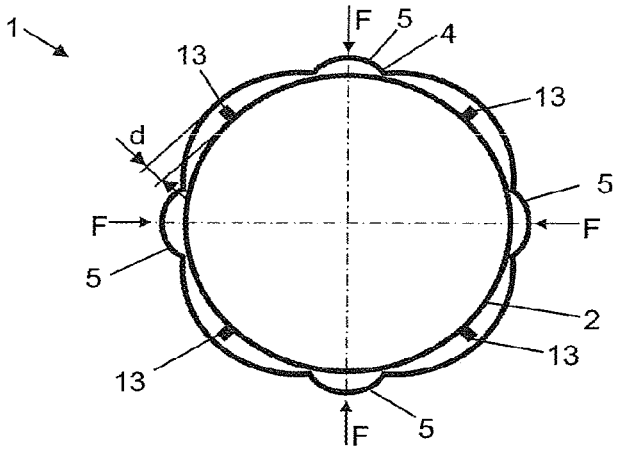
FIG. 4 shows a schematic representation according to FIG. 3, with the resulting deformation for disassembly.

FIG. 4 shows a schematic representation according to FIG. 3, with the resulting deformation for disassembly. Through the action of a force F in the direction of mid-axis 7 on the defined deformable zones 5, these zones are elastically deformed as far as possible so that the positive connection is dismantled. The dismantling of the positive connection results from the removal of the contact surface 6 from the complementary contact surface 11 in the predominantly radial direction. The contact surface 6 and the complementary contact surface 11 need not contact one another immediately, in contrast to the embodiment shown in FIG. 1. The two contact surfaces 6 and 11 may have a small distance between them. Due to the convex curvature of contact surface 6 and 11, based on the embodiment of the cover element 4 and of the drive element 2 as a rotational component, the curved contact 6 is also deformed by the cause of the deformation of the zones 5. The radial distance of the contact surface 6 increases, and permits sufficient free access for a disassembly of the cover element 4 from the drive element 2.

Figure 5:
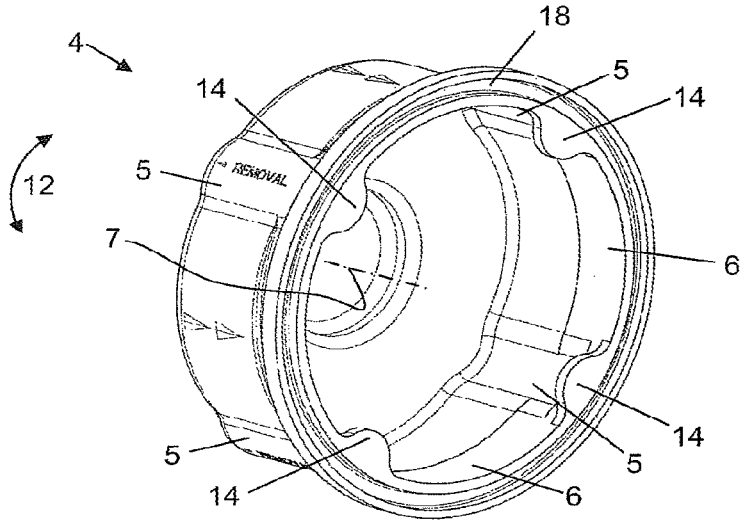
FIG. 5 shows a specific embodiment of a cover element.

FIG. 5 shows a specific embodiment of the cover element 4. The cover element 4 is fashioned as a predominantly thin-walled cup-shaped part. The deformable zones 5, which are clearly defined optically and topographically and are fashioned as a convex bulge 9, extend almost over the entire axial constructive length of the cover element 4, along the mid-axis 7. The cover element 4 has at its open end connecting links 14 integrally formed thereon in one piece, distributed uniformly in the circumferential direction 12 and extending toward the mid-axis 7. These links 14 engage in crimp-shaped openings 15 of vanes 17 of the drive element 2 according to FIG. 6. On the open end of the cover element 4 there is further situated a groove 18. This groove 18 is open in the axial direction and is made completely circumferential in the circumferential direction 12. The groove 18 is provided as a receptacle for a sealing ring (not shown).

Figure 6:
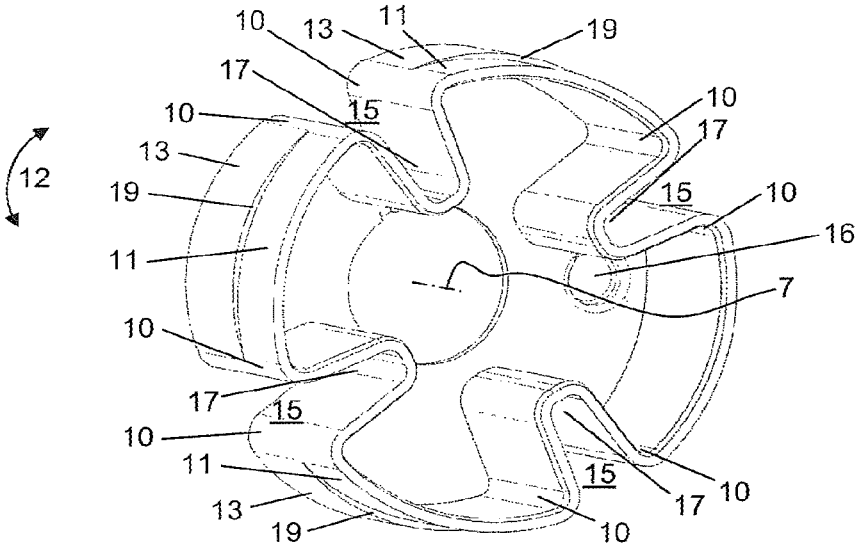
FIG. 6 shows a specific embodiment of a drive element for positive connection to the cover element according to FIG. 5.

FIG. 6 shows a specific embodiment of the drive element 2 for positive connection with the cover element 4 according to FIG. 5. The drive element 2 is also cup-shaped, and has vanes 17 that are directed radially inward, or towards the mid-axis 7. The circumferential wall of the cup-shaped drive element 2 is made as thin as possible, and forms the vanes 17 in one piece having almost the same wall thickness. The floor surface of the drive element 2 has a slotted piece for a locking mechanism. The regions on the outer diameter of the drive element 2, situated in the circumferential direction 12 between the vanes 17, have positive connecting elements 13 required for the positive joined connection. These are fashioned as sickle-shaped parts raised from the outer diameter of the drive element 2, and, going out from the closed side, do not extend completely over the axial constructive length of the drive element 2 along the mid-axis 7. The remaining axial constructive length up to the open side is provided for the complementary contact surface 11. A plurality of openings 15 of the vanes 17 interrupt, in the circumferential direction 12, this complementary contact surface 11, forming a plurality of complementary contact surfaces 11. Nonetheless, in this embodiment according to FIG. 6 the complementary contact surfaces have almost the same distance from the mid-axis 7. The sickle-shaped positive connecting element 13 has a radial shoulder 19 on its laterally situated complementary contact surface 11. In the positive joined connection 8, this radial shoulder 19 of the positive connecting element 13 forms a one-sided positive connection, and thus blocks an axial degree of freedom between the cover elements 4 according to FIG. 5 and the drive element 2 according to FIG. 6. In order to achieve a two-sided positive connection, the floor surfaces of the two components 2 and 4 can contact one another. Alternatively, the use of further components or the positive connecting elements 13 for the two-sided positive connection is conceivable.

The circumferential wall in the circumferential direction 12 and the openings 15 in the vanes 17 form a counter-support 10 in their transition region. When the cover element 4 according to FIG. 5 is joined to the drive element 2 according to FIG. 6, the connecting links 14 extend radially into these openings 15. The contact surfaces 6 and the complementary contact surfaces 11 stand opposite each other in the radial direction. If a force F is applied to the zones 5 of the cover element 4 according to FIG. 5, toward the mid-axis 7, the cover element 4 is supported on these counter-supports 10 of the drive element 2. The deformation of the zones 5 causes a deformation of the contact surfaces 6 away from the mid-axis 7, or the complementary contact surface 11. If sufficient access is created between the contact surface 6 and the complementary contact surface 11, at least at the height of the radial extension of sickle-shaped positive connecting elements, or the shoulder 19, then the cover element 4 can be moved along the mid-axis 7 relative to the drive element 2 and disassembled.

Figure 7:
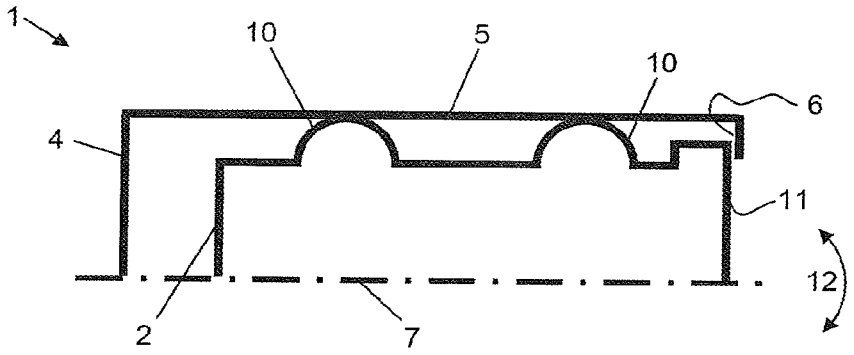
FIG. 7 shows a further schematic representation of components connected positively to one another in a side view of the camshaft adjuster.

FIG. 7 shows a further schematic representation of components 4 and 2 or 3, positively connected to one another, in the side view of the camshaft adjuster 1. The cup-shaped cover element 4 sheaths the drive element 2, which in this specific embodiment does not have to have a cup shape. The drive element 2 has on its outer circumference a plurality of counter-supports 10 that are oriented in the direction of extension of the mid-axis 7. The counter-supports 10 are fashioned as convex raised parts on the outer circumference of the drive element 2. The cover element 4 has on its open side a flange 20 that extends toward the mid-axis 7. The flange 20 has, on its side facing the floor of the cover element 4, the contact surface 6, which is situated at least partly opposite the complementary contact surface 11 of the drive element 2. The complementary contact surface 11 is situated on the side of the camshaft adjuster 1 facing away from the camshaft or facing the camshaft, and is thus situated on an end face of the drive element 2. The defined deformable zone 5 of the cover element 4 is situated between counter-supports 10. Zone 5 is provided as a region for applying the force F required for the disassembly or deformation of the cover element 4.

Figure 8:
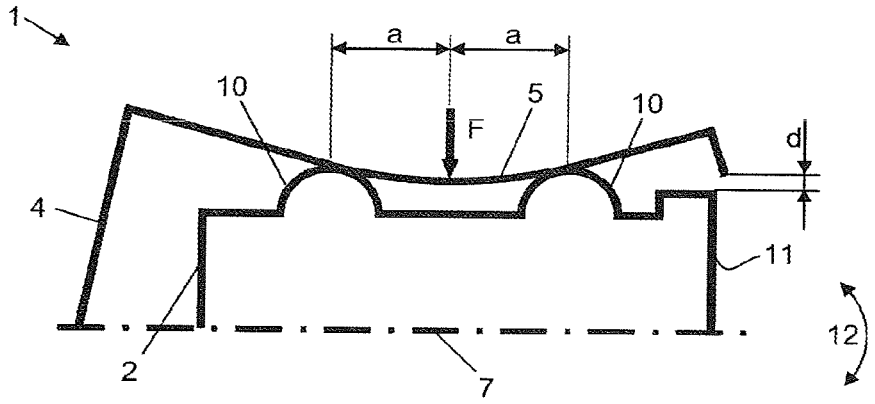
FIG. 8 shows a further schematic representation of components connected positively to one another with the resulting deformation for disassembly.

FIG. 8 shows a further schematic representation from FIG. 7 of components 4 and 2 or 3, connected positively to one another, with the resulting deformation for disassembly. The zone 5 is subjected to applied force F. Supported by the counter-supports 10, and resulting from a distance a of the force F to the counter-supports 10, the zone 5 is deformed toward the mid-axis 7. During this, the rest of the cover element 4 is deformed away from the mid-axis. In this way, the contact surface 6 of the cover element 4 is also moved away from complementary contact surface 11 of drive element 2, predominantly in the radial direction. Contact surface 6 and complementary contact surface 11 are now no longer situated opposite one another in the axial direction, and do not block any degree of freedom in the direction of extension of mid-axis 7. Cover element 4 is capable of being disassembled from drive element 2.

Figure 9:
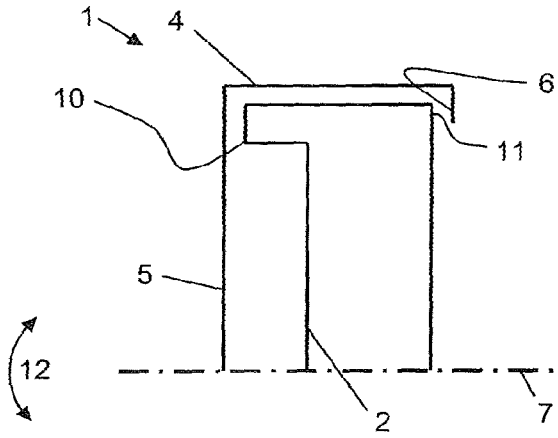
FIG. 9 shows a further schematic representation of components connected positively to one another in a side view of the camshaft adjuster.

FIG. 9 shows a further schematic representation of components 4 and 2 or 3, connected positively to one another, in a side view of a camshaft adjuster 1. The design resembles the schematic representation according to FIGS. 7 and 8, but with the difference that the counter-supports 10 are situated on an end surface of the camshaft adjuster 1. Advantageously, these counter-supports 10 are situated close to the outer circumference of the drive element 2. The cover element 4 sheaths the drive element 2, so that the contact surface 6 of the cover element 4 stands axially opposite the complementary contact surface 11 of the drive element 2. Alternatively, the contact surfaces 6 and 11 can be fashioned as circumferential surfaces of the components 2 and 4 and, through their radial contact, can produce a frictional connection that blocks the degrees of freedom in the circumferential direction 12 and in the axial direction.

Figure 10:
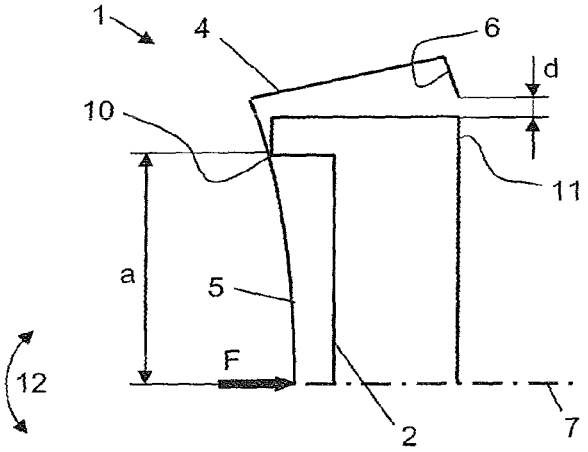
FIG. 10 shows a further schematic representation of components connected positively to one another with the resulting deformation for disassembly.

FIG. 10 shows a further schematic representation from FIG. 9 of components 2 and 4 or 3, with the resulting deformation for disassembly. The force F has been applied to the cover element 4 in the vicinity of the mid-axis 7. Preferably, the vector of force F is oriented parallel to the mid-axis 7, ideally in alignment therewith. As already shown in the preceding Figures, the vector of force F points toward the drive element 2. Due to the large distance a from counter-support 10, the cover element 4 is deformed in such a way that the contact surfaces 6 and 11 are no longer situated opposite one another in the axial direction. The cover element 4 can be disassembled.

LIST OF REFERENCE CHARACTERS

1 camshaft adjuster
2 drive element
3 output element
4 cover element
5 defined, deformable zone
6 contact surface
7 mid-axis
8 joined connection
9 bulge
10 counter-support
11 complementary contact surface
12 circumferential direction
13 positive connecting element
14 connecting link
15 opening
16 slotted part
17 vane
18 groove

19 shoulder
a distance
d distance
F force

The invention claimed is:

1. A camshaft adjuster comprising:

a drive element, an output element, and a cover element, the drive element and the output element being situated so as to be capable of rotation relative to one another, and a joined connection of the cover element to the drive element or to the output element, one of the drive element, the output element, or the cover element to be joined has a defined, deformable zone configured such that upon a deformation of the deformable zone a contact surface positioned circumferentially apart from the deformable zone of the one of the drive element, the output element, or the cover element of the joined connection experiences an increase in a distance (d) from a mid-axis, causing the joined connection to be released.

2. The camshaft adjuster as recited in claim 1, wherein a force (F) applied for the deformation of the deformable zone is oriented toward the one of the drive element, the output element, or the cover element.

3. The camshaft adjuster as recited in claim 1, wherein the deformable zone comprises a bulge in the one of the drive element, the output element, or the cover element.

4. The camshaft adjuster as recited in claim 1, wherein one of the drive element, the output element, or the cover element joined to one another is fashioned as a formed part or as a molded part.

5. The camshaft adjuster as recited in claim 3, wherein the bulge is provided as an angular positioning in order to achieve an orientation of the cover element to the drive element or to the output element.

6. The camshaft adjuster as recited in claim 2, wherein a respective other component of the drive element, the output element, or the cover element forming the joined connection with the one of the drive element, the output element, or the cover element has a counter-support located at a distance from the deformable zone for the applied force (F).

7. The camshaft adjuster as recited in claim 1, wherein an other one of the drive element, the output element, or the cover element has a complementary contact surface that forms a positive connection or a non-positive connection with a contact surface of the one of the drive element, the output element, or the cover element of the joined connection.

8. The camshaft adjuster as recited in claim 7, wherein the complementary contact surface of the other one of the drive element, the output element, or the cover element is circumferential or partially circumferential.

9. The camshaft adjuster as recited in claim 1, wherein the cover element sheathes the other of the drive element or the output element of the joined connection.

* * * * *